US005103600A

United States Patent [19]

Geiger et al.

[11] Patent Number: 5,103,600

[45] Date of Patent: Apr. 14, 1992

[54] MULTI-PURPOSE STADIUM

[76] Inventors: David H. Geiger, 7 Kirby Ln., Rye, N.Y. 10580; David M. Campbell, 45B Dunes Ln., Port Washington, N.Y. 11050

[21] Appl. No.: 359,403

[22] Filed: May 31, 1989

[51] Int. Cl.[5] ..... E04B 1/18

[52] U.S. Cl. ..... 52/6; 52/7; 52/126.5; 52/66

[58] Field of Search ..... 52/6-10, 52/22, 28, 473, 66, 63, 126.5, , 6, 7, 126.5; 403/13, 14, 304; 428/145, 248

[56] References Cited

U.S. PATENT DOCUMENTS

| | | | |
|---|---|---|---|
| 1,559,739 | 11/1925 | Brown | 52/7 |
| 3,263,380 | 8/1966 | Bourbonnais | 52/126.5 X |
| 3,394,505 | 7/1968 | Rife | 52/126.5 X |
| 3,399,887 | 9/1968 | Altier | 52/7 X |
| 3,975,869 | 8/1976 | Bouton | 52/9 |
| 4,452,848 | 6/1984 | Geiger | 428/247 |
| 4,472,470 | 9/1984 | Modic | 428/145 |
| 4,608,785 | 9/1986 | Rhodes et al. | 52/63 X |
| 4,637,496 | 1/1987 | Atkey et al. | 187/95 |
| 4,686,799 | 8/1987 | Kwake | 52/8 |
| 4,831,792 | 5/1989 | Berger | 52/6 X |
| 4,907,793 | 3/1990 | Wund | 52/6 |

FOREIGN PATENT DOCUMENTS

| | | | |
|---|---|---|---|
| 2746636 | 4/1979 | Fed. Rep. of Germany | 52/6 |
| 192950 | 11/1964 | Sweden . | |
| 887788 | 12/1981 | U.S.S.R. | 52/6 |

*Primary Examiner*—John E. Murtagh
*Assistant Examiner*—Wynn Wood
*Attorney, Agent, or Firm*—Fitzpatrick, Cella, Harper & Scinto

[57] ABSTRACT

This invention provides for a multi-purpose stadium which includes a first activity area having a natural turf playing field and a second activity area positioned below the first activity area. The first activity area is supported on a platform vertically movable with respect to the second activity area allowing for spectator sightlines to be satisfied for events occurring within the first and second activity areas. The first activity area is supported within the stadium by a plurality of piers. Each pier includes a hollow column with a continuous slot on the interior face thereof which supports a hydraulic lifting device. The hydraulic lifting devices vertically move the first activity area relative to the second activity area. Alternatively, a counterweight system may be employed to lift the first activity area.

75 Claims, 5 Drawing Sheets

MULTI-PURPOSE STADIUM

BACKGROUND OF THE INVENTION

This invention relates to a multi-purpose stadium, and more particularly, to a multi-purpose stadium which not only maximizes the number of events which may occur simultaneously therein, but also permits the activities to occur indoors or outdoors depending upon weather conditions.

This multi-purpose stadium permits field events such as football, soccer and/or baseball to occur for reasons of customs and/or rules on natural turf and depending upon weather conditions, either outdoors or indoors. These requirements must be balanced against the economic requirement that a multi-purpose stadium facility maximize the different types of events it can attract i. e., concerts, conventions, trade shows, tractor pulls, indoor arena events, and outdoor field events which preferably occur on natural turf.

In the past, in order to provide for varying conditions under which an event may take place, stadiums, notably in Montreal and Toronto, have been provided with retractable roofs. In these stadia, the playing field is composed of artificial turf, and as such, it must be rolled up and stored to permit the stadium to be used for other events, such as concerts, trade shows, etc. The set-up involved in storing the artificial turf is, however, extremely labor intensive. Additionally, since the roof has a solid surface and is not transparent to the sunlight, the playing field cannot be composed of natural turf. Due to custom and potential athletic injury concerns, it is desirable to have a natural grass surface for various sporting events, i.e. football, baseball and soccer, etc.

Typically, a municipality will have separate facilities for indoor events, such as basketball, concerts and trade shows, and outdoor events, such as soccer, baseball, and football games. As a result thereof, these facilities, even though multi-purpose, do not allow for a number of events to occur simultaneously therein, and hence, lease revenues to the owner of the stadium are diminished. Accordingly, and since space is limited in urban areas, it is desirable to provide a multi-purpose stadium wherein these types of separate facilities can be combined within a unitary multi-purpose stadium.

Additionally, in many metropolitan areas, the only land available to construct a multi-purpose stadium is parkland. Obviously, if a typical stadium is built in a park, the park size is diminished thereby promoting public objection to construction of the stadium. It is therefore also desirable to provide a stadium which does not disturb the park environment.

OBJECTS OF THE INVENTION

It is a general object of this invention to provide a multi-purpose stadium.

It is also an object of this invention to provide a multi-purpose stadium wherein a plurality of events may occur in the stadium simultaneously.

It is another object of this invention to provide a multi-purpose stadium having an activity area which includes a natural turf playing field that can be stored outdoors to promote the maintenance and health of the turf.

It is yet another object of this invention to provide a means of allowing the use of natural turf in a multi-purpose stadium without the limitations in multi-purpose use that are presently experienced in facilities with natural turf fields.

It is a further object of this invention to provide a means of minimizing the cost and event change over time from field events to non-field events in a multi-purpose stadium.

It is yet another object of this invention to provide a multi-purpose stadium having a retractable roof which not only permits sunlight to impinge upon a natural turf playing field, but also allows this playing field to be stored at the opening of the roof exteriorly of the stadium.

It is still a further object of this invention to provide a multi-purpose stadium which includes a membrane roof which is retractable and allows events occurring on a natural turf field to occur either outdoors or under a transparent or translucent cover depending upon weather conditions.

It is yet another object of this invention to provide a multi-purpose stadium having a plurality of activity areas wherein one of the activity areas can be raised relative to another activity area thereby allowing for sight lines to be satisfied for a variety of events occurring simultaneously within the stadium.

Other objects and advantages of the invention will become apparent from the following detailed description and from the appended drawings in which like numbers have been used to designate like parts in the several views.

SUMMARY OF THE INVENTION

A multi-purpose stadium is provided which includes a first activity area and a second activity area positioned below the first activity area. The first activity area is supported on a platform truss structure and is vertically movable relative to the second activity area allowing sightlines to be satisfied for the various events occurring simultaneously in the first and second activity areas. Due to custom and player satisfaction, the upper surface of the platform forming the first activity area preferably includes a playing field composed of earth and natural grass (i.e., a natural turf playing field).

In order to move the first activity area relative to the second activity area, this multi-purpose stadium includes a means for lifting the first activity area vertically. To that end, the first activity area is supported within the stadium by a plurality of piers positioned at the corners of the first and second activity areas. Each of the piers includes a hollow column with a continuous slot on the interior face thereof which supports a hydraulic lifting device which vertically moves the first activity area. Alternatively, the first activity area may be moved vertically by a counterweight system. This system includes a pulley supported to each pier at the top thereof. A cable is wound around the pulley with one end connected to the first activity area and one of the counterweights being operatively connected to the other end of each cable. The pulley may be activated, and hence, the first activity area may be raised or lowered by use of electric motors and/or by water tanks incorporated into the counterweight wherein water is added to or removed from the water tanks.

The multi-purpose stadium also includes a spectator viewing area for viewing events occurring in either of the first and/or second activity areas. The spectator viewing area includes an upper seating level, an intermediate seating level, and a lower seating level. The intermediate seating level includes a plurality of sky boxes. Due to the design of this stadium, the first activity area moves independently of the spectator viewing area. Furthermore, an additional mid-level seating area may be incorporated into the platform truss structure supporting the first activity area.

In order to alter the configuration of each activity area so that a variety of events may take place therein, the platform is movable with respect to the second activity area between a lower position, a middle position, and an upper position. In the platform lower position, the first activity area is positioned directly above the second activity area such that a event in the first activity area may be viewed by spectators in the intermediate and upper seating levels. In the platform middle position, the first activity area is positioned between the intermediate and upper seating levels such that an event in the first activity area may be viewed by spectators in the upper seating level and an event in the second activity level may be viewed simultaneously by spectators in the lower and intermediate seating levels. In the platform upper position, the first activity area encloses an opening in the roof of the stadium such that the natural turf playing surface is stored in a remote position from the stadium interior and an event in the second activity area may be viewed by spectators in the lower, intermediate and upper seating levels. Since the first activity area may be moved to other vertical positions, an unlimited amount of seating arrangements is possible.

In order to maximize the utilization of the stadium space, the second activity area may be partitioned by a dividing wall into a first lower arena and a second lower arena. The additional equipment necessary for the first and second lower arenas may also be stored within the platform supporting the first activity area.

Additionally, in order to permit the activities in the first activity area to take place under a variety of conditions, the stadium includes a retractable roof having an opening therein positioned generally above the first activity area. This opening may be covered by a transparent membrane to allow maximum heat gain into the first activity area. Alternatively, the opening may be covered by a translucent, highly reflective fabric to minimize heat gain into the first activity area. As aforementioned, the opening may be covered by the first activity area in the platform upper position such that the first activity area is stored at the opening, thus allowing an enclosed facility.

As such, a multi-purpose stadium is provided which permits a number of events to occur simultaneously in a unitary structure, and in addition, allows for spectator sightlines to be satisfied regardless of the events taking place in each area. Furthermore, these events can occur in the vertically movable first activity area regardless of the weather conditions outside.

BRIEF DESCRIPTION OF THE DRAWINGS

The following detailed description, given by way of example but not intended to limit the invention solely to the specific embodiments described, may best be understood in conjunction with the accompanying drawings in which.

DETAILED DESCRIPTION OF THE PREFERRED EMBODIMENT

Figure 1:
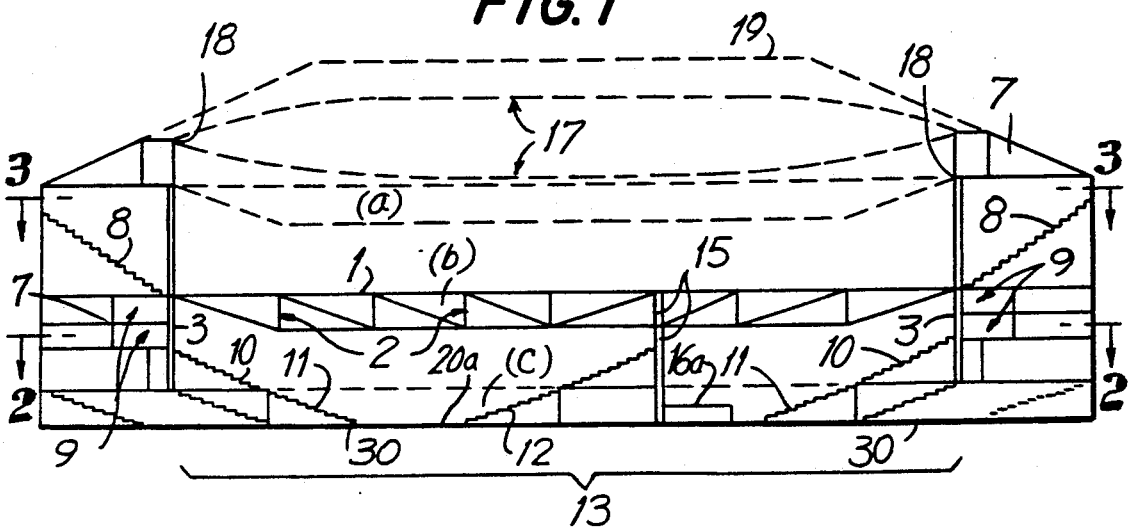
FIG. 1 is a front plan view of a preferred embodiment of the multi-purpose stadium of this invention illustrating in solid lines an intermediate position of the platform truss structure and in broken lines the lower and upper positions of the platform truss structure.
Figure 2:
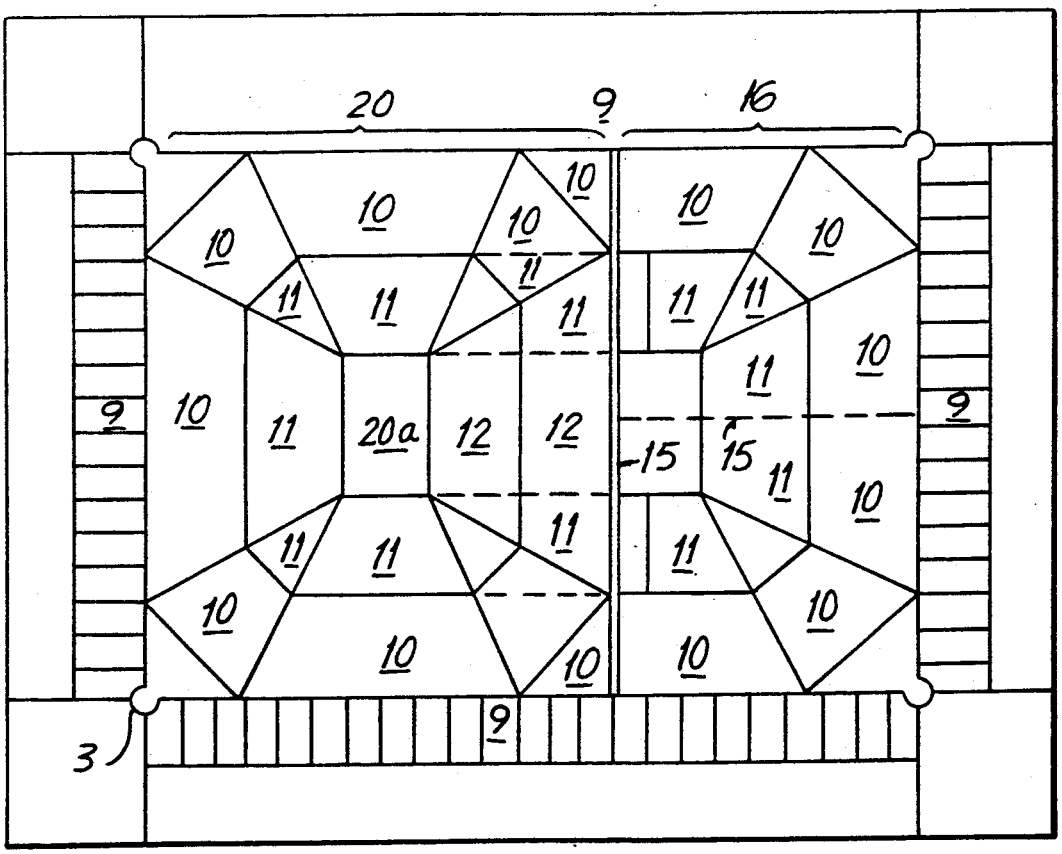
FIG. 2 is a top plan view taken along the line 2—2 of FIG. 1.
Figure 3:
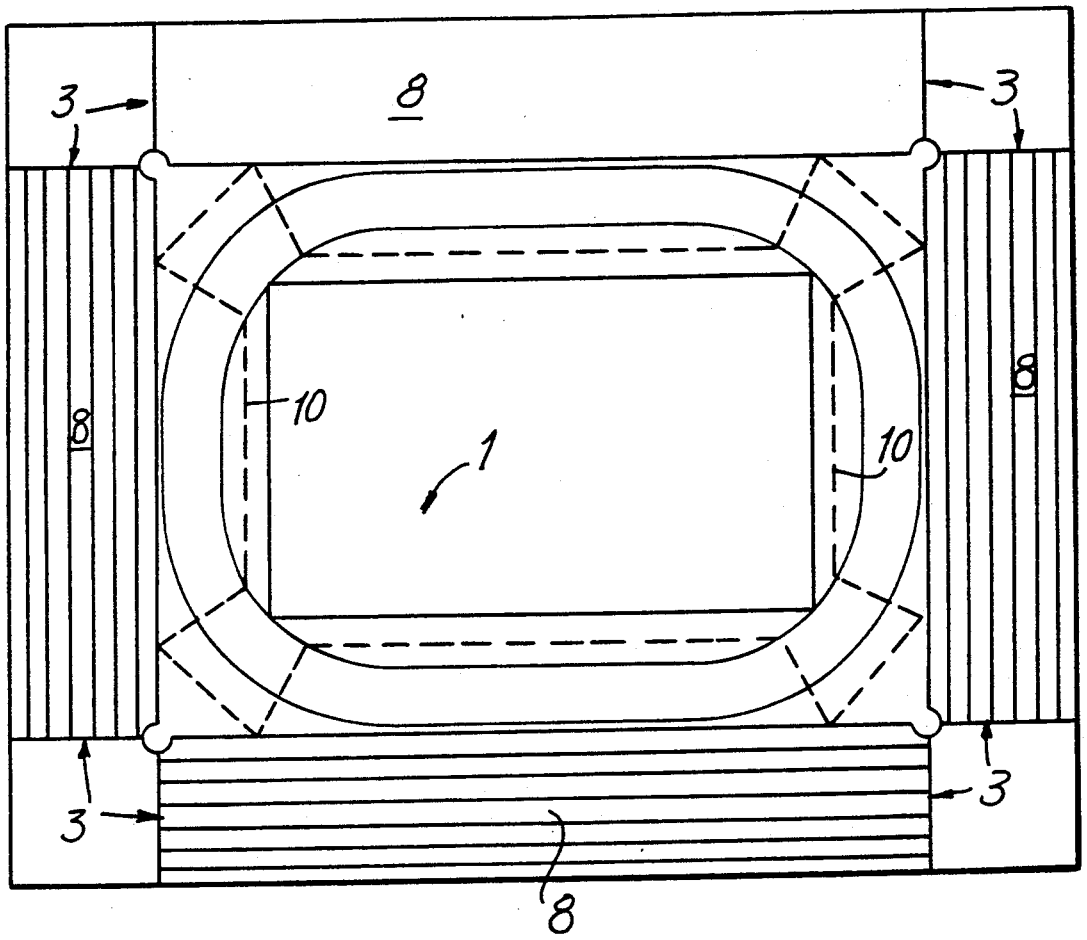
FIG. 3 is a top plan view taken along line 3—3 of FIG. 1.

Referring now to FIGS. 1-3, a multi-purpose stadium is illustrated which includes a first activity area or playing field 1 which is vertically supported above a second activity area 13. The first activity area preferably includes a playing field composed of earth and natural grass. As a result thereof, the first activity area is suitable for events such as baseball, soccer and football as well as possibly track and field meets, etc.

Figure 4:
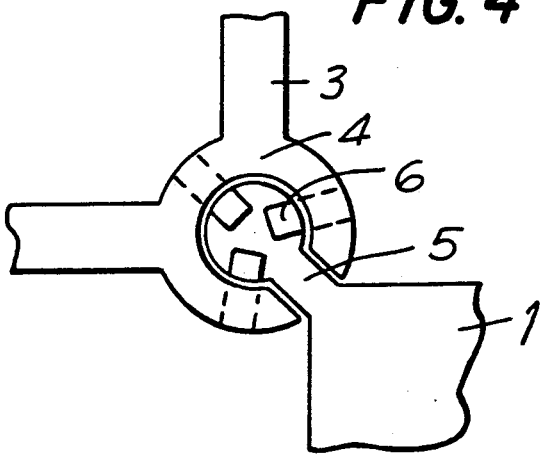
FIG. 4 is a top plan view illustrating a preferred embodiment of one of the piers supporting one of the hydraulic lifting devices of this invention.

The first activity area is supported by a platform truss structure 2, the upper surface of which forms the first activity area. The platform truss structure is supported in turn by four piers 3 at each of the four corners of the first activity area 1. As shown in FIG. 4, these piers may consist of a hollow column 4 with a continuous slot 5 on the interior face thereof which allows to be supported on a hydraulic lifting device 6. The hydraulic lifting device is similar to that used to lift oil rig platforms. These piers have adequate capacity to resist the horizontal forces transmitted upon them by the first activity area 1 and the platform truss 2.

Figure 5:
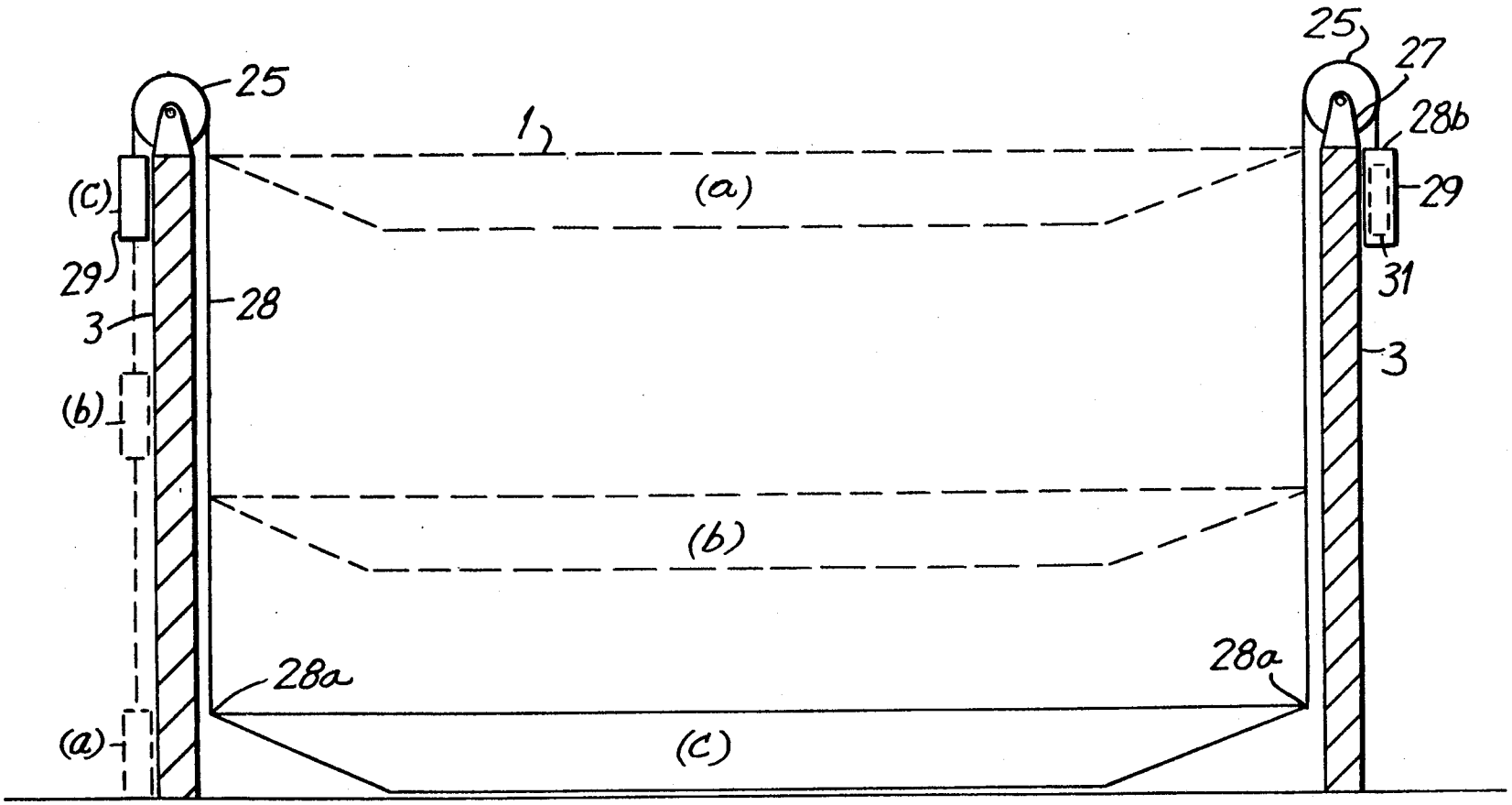
FIG. 5 is a front elevational view of the multi-purpose stadium of this invention illustrating a counterweight system being used to raise and lower the first activity area.

Alternatively, as shown in FIG. 5, the first activity area 1 may be moved vertically by a counterweight system. This system includes a pulley 25 supported to each pier 3 at the top 27 thereof. A cable 28 is wound around each pulley with the first activity area 1 and counterweight 29 operatively connected to the ends 28*a* and 28*b*, respectively, of the cable. The pulley may be activated, and hence, the first activity area may be raised or lowered by use of electric motors (not shown) or by water tanks 31 incorporated into each counterweight wherein water is added to or removed from the water tank to adjust the weight of the counterweight.

The multi-purpose stadium also includes a spectator viewing area for viewing events occurring in either of the first and/or second activity areas The spectator viewing area includes an upper seating level 8, intermediate seating level 10, and a lower seating level 11. The intermediate seating level includes a plurality of sky boxes 9. Due to the design of this stadium, the first activity area moves independently of any of the spectator viewing areas except perhaps additional mid-level seating 30 incorporated in the platform truss structure supporting the first activity area, as will be described in more detail below.

As a result of the hydraulic lifting system 6 (FIG. 4), or alternatively counterweight system (FIG. 5), the first activity area can be placed in any vertical position relative to the second activity area (and likewise, the spectator viewing areas) to allow sightlines to be satisfied for the variety of events occurring in the first and second activity areas. In an upper position of the platform designated as (a) in FIG. 1, the platform area encloses the opening between the roof canopy membrane 7 between the piers 3 and further provides a canopy for the upper seating level 8. In this upper position, the second activity area 13 is enclosed with an opaque roof and spectators in the upper seating level 8, the intermediate seating level 10 including sky boxes 9 and the lower seating level 11 may view the event taking place therein.

In a middle position of the platform designated as (b) in FIG. 1, an event occurring in the first activity area 1, such as track and field and soccer (see FIG. 3), may be viewed by spectators in the upper seating level 8. Simultaneously therewith, events may take place in the second activity area 13. The event occurring in the second activity area may be viewed by spectators seated in the lower and intermediate seating levels 10 and 11. In order to maximize the versatility of the second activity area 13, it may be separated by a soundproof dividing wall 15 into two separate arenas or theaters, providing for a first lower arena 20 with an arena floor 20*a* and a second lower arena 16 with an arena floor 16*a*. The dividing wall 15 as well as the additional equipment necessary for the two lower arenas, such as the extra seating for the individual lower arenas and the theater stage in the second lower arena, may be stored within a storage compartment within the platform truss structure 2.

In a lower position of the platform designated as (c) in FIG. 1, the first activity area 1 is now in such a position that the intermediate seating level 10 may be moved from a retracted position to a position adjacent to the playing field thus allowing field events, such as baseball, soccer, football, and track and field to be viewed by spectators seated in the upper seating level 8 and the intermediate seating level 10.

Figure 6:
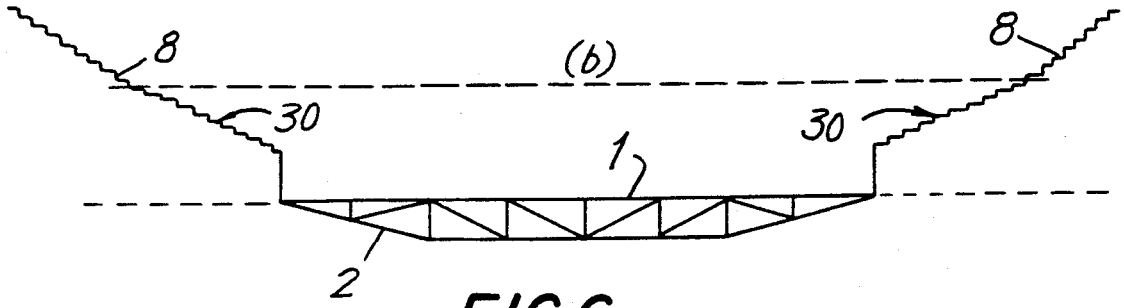
FIG. 6 is a front elevational view illustrating a preferred embodiment of the platform for the first activity area being positioned for use as a football field with respect to the upper seating level and additional mid-level seating which can be incorporated into the platform truss structure.
Figure 7:
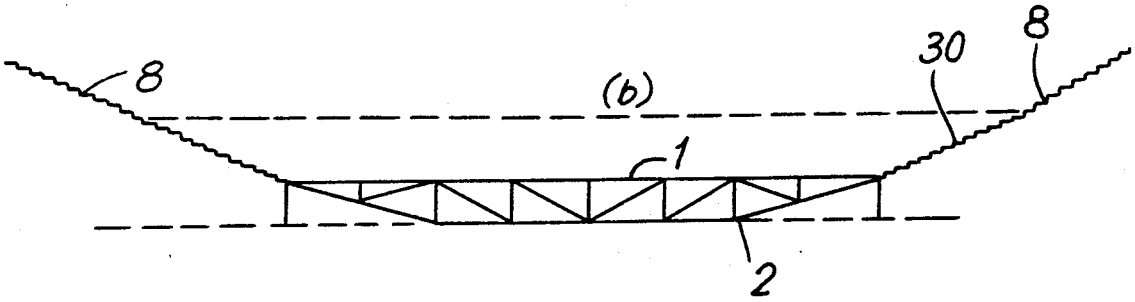
FIG. 7 is a front elevational view illustrating a preferred embodiment of the platform for the first activity area being positioned for use as a soccer field with respect to the upper seating level and additional mid-level seating which can be incorporated into the platform truss structure.

Alternatively, if the field is to be used for soccer and/or football, additional mid-level seating 40 may be built into the platform and together with the field form a bowl which is more efficient structurally. The field may be moved relative to the edges of the bowl allowing for site lines to be satisfied for soccer as well as football (see FIGS. 6 and 7). In this case, the mid-level seating is used with the first activity area being vertically moved generally to a middle position.

Additionally, in order to permit the activities in the first activity area to take place under a variety of weather conditions, the multi-purpose stadium includes a retractable roof having an opening therein which is positioned generally above the first activity area. In the middle and lower positions of the platform, the events occurring therein can be still held indoors by deploying a lenticular air inflated roof 17 which may be stored in compartments 18 located at either side of the roof opening. Since storage space is present at either end of the roof opening, two roofs can be stored, one of transparent film and the other of a highly reflective fabric. In this manner, the roof can be open, or in the winter, the roof opening may be covered with a transparent film thus maximizing heat gain into the first activity area, or in the summer, the roof opening may be covered with a translucent highly reflective fabric to maximize heat reflection.

In another preferred embodiment, by supporting off of an external lattice framework 19, the retractable roof can be a tensile structure retracting into the storage compartments 18. Additionally, the roof can be a fixed transparent roof of film or glass with reflective or opaque horizontal curtains used to control sunlight.

With the first activity field which provides for a natural turf playing field in its upper or intermediate position and with the seating levels 10, 11 and 12 all or partially retracted below the upper level seating 8, the arena floor 30 (see FIG. 1) of the second activity area can be used for a convention center or trade floor. With the first activity area 1 in its upper position, the retractable roof can be deployed and, if a lenticular roof is utilized, the cells may be brought together and the interior space above the first activity area would be pressurized thus allowing for an enclosed natural turf practice field at the top of the stadium. Moreover, in the upper position of the platform, the natural turf playing field of the first activity area can extend exteriorly of the multi-purpose stadium such that a practice session may take place outdoors on natural turf.

Figure 8:
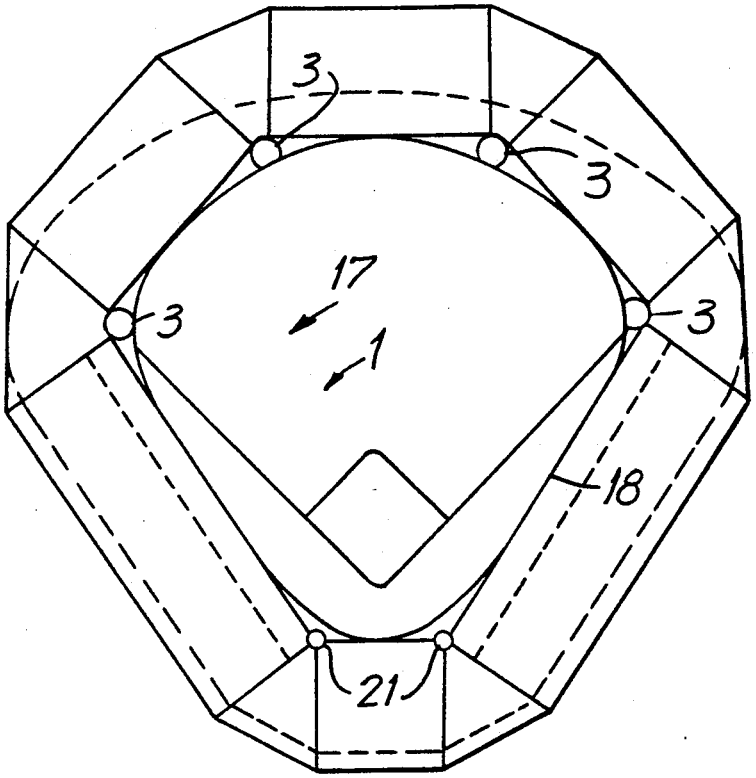
FIG. 8 is a top plan view of the multi-purpose stadium of this invention being used as a baseball field and further illustrating the first activity area being raised to an upper position.
Figure 9:
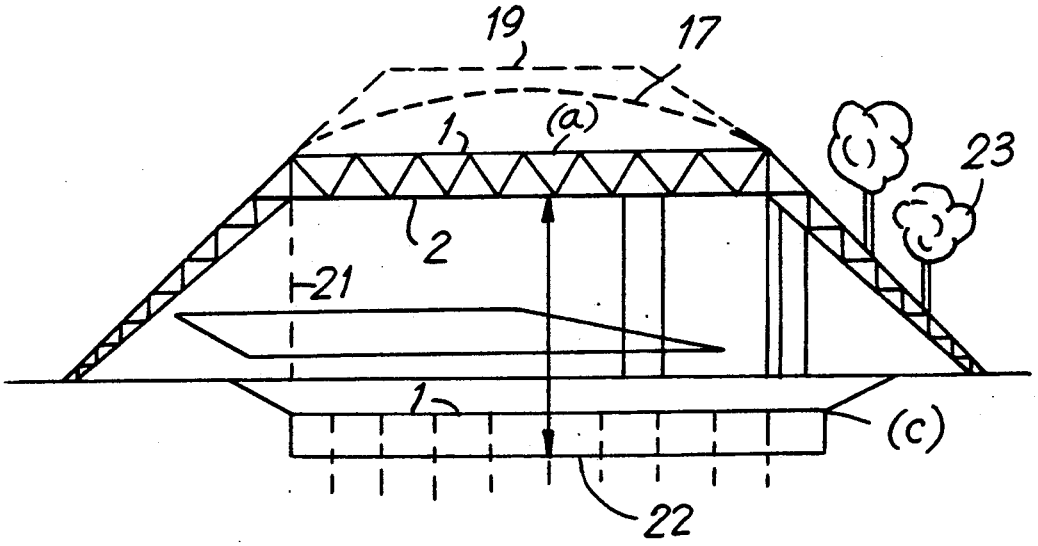
FIG. 9 is a front elevational view of the multi-purpose stadium of FIG. 8.

As shown in FIGS. 8 and 9, the multi-purpose stadium can be utilized for a baseball field as well. In this case, in addition to piers 3 supporting the field 1, cables 21 support the playing field 1. These cables can remain in position to support the screen in back of home plate or can be retracted to the top of the roof when the platform is in its lower position. With the platform in its upper position supporting the natural turf playing field it is possible to play baseball indoors by having a hydraulically activated field with artificial turf 22 lifted into position (see FIG. 9). Alternatively, as aforedescribed, a retractable roof 17 which is either translucent and/or transparent may be employed depending upon the desired playing conditions and/or outdoor weather conditions.

Since in many metropolitan areas, the only land available to build such a multi-purpose stadium is park land, the design of this multi-purpose stadium retains the enhanced environmental qualities of a park. By treating the sloping surface of the fixed roof of the stadium as a terraced berm with the planting of trees and bushes 23 (FIG. 9), the stadium can be treated as a landscaped mountain or hill with a flattop having a natural turf playing field for events such as baseball, soccer, or football. The first activity area may nonetheless be moved into its other positions within the stadium interior. Accordingly, for the balance of the events, the stadium can form a portion of the park with the lower arenas being used for the multi-purpose activities. Such a structure hence mitigates the environmental impact of building such a stadium in a metropolitan area.

While the invention has been particularly shown and described with reference to certain preferred embodiments, it will be readily appreciated by those of ordinary skill in the art that various changes and modifications may be made without departing from the spirit and scope of the invention. It is intended that the appended claims be interpreted as including the foregoing as well as various other such changes and modifications.

What is claimed is:

1. A multi-purpose stadium comprising a first activity area and a second activity area, at least a portion of which is positioned directly below said first activity area in a fixed position; a seating area located around at least the perimeter of the portion of the second activity area positioned below the first area and the corresponding position of the first activity area; said first activity area being vertically movable with respect to said second activity area allowing for spectator sightlines to be satisfied from said seating area for simultaneous events occurring within said first and second activity areas when said first activity area is in a position vertically above and spaced a predetermined distance from said second activity area.

2. The multi-purpose stadium of claim 1 wherein said first activity area is supported above said second activity area on an upper surface of a vertically movable platform.

3. The multi-purpose stadium of claim 2 wherein said first activity area includes a natural turf playing field.

4. The multi-purpose stadium of claim 1 and further including a roof having a retractable opening positioned generally above said first activity area.

5. The multi-purpose stadium of claim 4 wherein said opening is covered by a transparent membrane to allow maximum heat gain into said first activity area.

6. The multi-purpose stadium of claim 4 wherein said opening is covered by a translucent highly reflective fabric to minimize heat gain into said first activity area.

7. A multi-purpose stadium comprising the first activity area and a second activity area, at least a portion of which is positioned directly below said first activity area, said first activity area being vertically movable with respect to said second activity area allowing for spectator sightlines to be satisfied for simultaneous events occurring within said first and second areas; and a roof having a retractable opening positioned generally above said first activity area; said opening being covered by said first activity area.

8. A multi-purpose stadium comprising the first activity area and a second activity area, at least a portion of which is positioned directly below said first activity area, said first activity area being vertically movable with respect to said second activity area allowing for spectator sightlines to be satisfied for simultaneous events occurring within said first and second areas; and a roof having a retractable opening positioned generally above said first activity area; said opening being covered a fixed transparent film with reflective horizontal curtains used to control sunlight.

9. A multi-purpose stadium comprising the first activity area and a second activity area, at least a portion of which is positioned directly below said first activity area, said first activity area being vertically movable with respect to said second activity area allowing for spectator sightlines to be satisfied for simultaneous events occurring within said first and second areas; and a roof having a retractable opening positioned generally above said first activity area; said opening being covered by a fixed transparent glass with opaque horizontal curtains used to control sunlight.

10. The multi-purpose stadium of claim 1 wherein said first activity area is vertically movable with respect to said second activity area by hydraulic means.

11. The multi-purpose stadium of claim 10 wherein said first activity area is supported within the stadium by a plurality of piers.

12. The multi-purpose stadium of claim 11 wherein each said pier includes a hollow column with a continuous slot on the interior face thereof which supports said hydraulic means.

13. The multi-purpose stadium of claim 1 wherein said first activity area is vertically movable with respect to said second activity area by a counterweight system.

14. The multi-purpose stadium of claim 13 wherein said counterweight system includes a plurality of counterweights operatively connected to said first activity area with each counterweight being connected to a cable wound around a pulley supported to one of a plurality of piers which in turn support first activity area.

15. The multi-purpose stadium of claim 1 and further including a spectator viewing area for viewing events occurring in either of said first and second activity areas.

16. The multi-purpose stadium of claim 15 wherein said first activity area moves vertically independent of said spectator viewing area.

17. A multi-purpose stadium comprising a first activity area and a second activity area, at least a portion of which is positioned directly below said first activity area, said first activity area being vertically movable with respect to said second activity area allowing for spectator sightlines to be satisfied for simultaneous events occurring within said first and second activity areas; and a spectator viewing area for viewing events occurring in either of said first and second activity areas; said spectator viewing area including mid-level seating which can be made part of a vertically movable platform supporting said first activity area above said second activity area.

18. The multi-purpose stadium of claim 15 wherein said spectator viewing area includes an upper seating level, an intermediate seating level, and a lower seating level.

19. The multi-purpose stadium of claim 18 wherein said intermediate seating level includes a plurality of sky boxes.

20. A multi-purpose stadium comprising a first activity area and a second activity area, at least a portion of which is positioned directly below said first activity area, said first activity area being vertically movable with respect to said second activity area allowing for spectator sightlines to be satisfied for simultaneous events occurring within said first and second activity areas; and a spectator viewing area for viewing events occurring in either of said first and second activity areas; said spectator viewing area including an upper seating level, an intermediate level, and a lower seating level; said first activity area being movable with respect to said second activity area between a lower position, a middle position and an upper position.

21. The multi-purpose stadium of claim 20 wherein in said lower position, said first activity area is positioned directly above said second activity area such that an event in said first activity area is viewed by spectators in said intermediate and upper seating levels.

22. The multi-purpose stadium of claim 21 wherein said intermediate seating level is movable from a retracted position to a position adjacent to said first activity area.

23. The multi-purpose stadium of claim 21 wherein said lower seating level may be moved to a retracted position underneath said upper seating level such that said first activity area may be positioned directly above said second activity area.

24. The multi-purpose stadium of claim 20 wherein in said middle position, said first activity area is positioned between said intermediate and upper seating levels such that an event in said first activity area is viewed by spectators in said upper seating level and an event in said second activity level is viewed simultaneously by spectators in said lower and intermediate seating levels.

25. The multi-purpose stadium of claim 20 wherein in said upper position, said first activity area encloses the stadium and an event in said second activity area is viewed by spectators in said lower, intermediate and upper seating levels.

26. The multi-purpose stadium of claim 1 wherein said second activity area may be partitioned by a dividing wall into a first lower arena and a second lower arena.

27. The multi-purpose stadium comprising a first activity area and a second activity area, at least a portion of which is positioned directly below said first activity area, said first activity area being vertically movable with respect to said second activity area allowing for spectator sightlines to be satisfied for simultaneous events occurring within said first and second activity areas; said second activity area being partitioned by a dividing wall into a first lower arena and a second lower arena; and equipment for said first and second lower arenas being stored within a platform supporting said first activity area.

28. The multi-purpose stadium of claim 26 wherein simultaneous events may occur in said first activity area and said first and second lower arenas.

29. A multi-purpose stadium comprising a roof covering the stadium having a retractable roof opening; a first activity area in alignment generally with said roof opening and having a natural turf playing field and a second activity area positioned below said first activity area, said first activity area being supported on a platform vertically movable with respect to said second activity area allowing for spectator sightlines to be satisfied for events occurring within said first and second activity areas.

30. The multi-purpose stadium of claim 29 wherein said roof opening is covered by a transparent membrane to allow maximum heat gain into said first activity area.

31. The multi-purpose stadium of claim 29 wherein said opening is covered by a translucent highly reflective fabric to minimize heat gain into said first activity area.

32. The multi-purpose stadium of claim 29 wherein said opening is covered by a fixed transparent film with reflective horizontal curtains used to control sunlight.

33. The multi-purpose stadium of claim 29 wherein said opening is covered by a fixed transparent glass with opaque horizontal curtains used to control sunlight.

34. The multi-purpose stadium of claim 29 wherein said roof opening is covered by said platform such that said natural turf playing field of said first activity area is exposed exteriorly of the stadium.

35. The multi-purpose stadium of claim 29 and further including a spectator viewing area for viewing the events occurring in either of said first and second activity areas.

36. The multi-purpose stadium of claim 35 wherein said first viewing area moves vertically independent of said spectator viewing area.

37. The multi-purpose stadium of claim 35 wherein said spectator viewing area includes mid-level seating which can be made part of said platform.

38. The multi-purpose stadium of claim 35 wherein said spectator viewing area includes an upper seating level, an intermediate seating level, and a lower seating level.

39. The multi-purpose stadium of claim 38 wherein said intermediate seating level includes a plurality of sky boxes.

40. The multi-purpose stadium of claim 38 wherein said platform is movable with respect to said second activity area between a lower position, a middle position, and an upper position.

41. The multi-purpose stadium of claim 40 wherein in said platform lower position, said first activity area is positioned directly above said second activity area such that an event in said first activity area is viewed by spectators in said intermediate and upper seating levels.

42. The multi-purpose stadium of claim 41 wherein said lower seating level can be moved to a retracted positioned underneath said upper seating level such that said first activity area is positioned directly above said second activity area.

43. The multi-purpose stadium of claim 41 wherein said intermediate seating level is movable from a retracted position to a position adjacent to said first activity area.

44. The multi-purpose stadium of claim 40 wherein in said platform middle position, said first activity area is positioned between said intermediate and upper seating levels such that an event in said first activity area is viewed by spectators in said upper seating level and an event in said second activity level is viewed simultaneously by spectators in said lower and intermediate seating levels.

45. The multi-purpose stadium of claim 40 wherein in said platform upper position, said first activity area encloses said opening such that said natural turf playing field is stored in a remote position from the stadium interior and an event in said second activity area is viewed by spectators in said lower, intermediate and upper seating levels.

46. The multi-purpose stadium of claim 29 wherein simultaneous events may occur in said first and second activity areas.

47. The multi-purpose stadium of claim 29 wherein said first activity area is vertically movable with respect to said second activity area by hydraulic means.

48. The multi-purpose stadium of claim 47 wherein said first activity area is supported within the stadium by a plurality of piers.

49. The multi-purpose stadium of claim 48 wherein each said pier includes a hollow column with a continuous slot on the interior face thereof which supports said hydraulic means.

50. The multi-purpose stadium of claim 29 wherein said first activity area is vertically movable with respect to said second activity area by a counterweight system.

51. The multi-purpose stadium of claim 50 wherein said counterweight system includes a plurality of counterweights operatively connected to said first activity area with each counterweight being connected to a cable wound around a pulley supported to one of a plurality of piers which in turn support said first activity area.

52. A multi-purpose stadium comprising a first activity area having a natural turf playing field and a second activity area positioned below said first activity area, said first activity area being supported on a platform vertically movable with respect to said second activity area allowing for spectator sightlines to be satisfied for events occurring within said first and second activity areas.

53. The multi-purpose stadium of claim 52 wherein said first activity area is vertically movable with respect to said second activity area by hydraulic means.

54. The multi-purpose stadium of claim 53 wherein said first activity area is supported within the stadium by a plurality of piers.

55. The multi-purpose stadium of claim 48 wherein each said pier includes a hollow column with a continuous slot on the interior face thereof which supports said hydraulic means.

56. The multi-purpose stadium of claim 52 wherein said first activity area is vertically movable with respect to said second activity area by a counterweight system.

57. The multi-purpose stadium of claim 56 wherein said counterweight system includes a plurality of counterweights operatively connected to said first activity area with each counterweight being connected to a cable wound around a pulley supported to one of a plurality of piers which in turn support said first activity area.

58. The multi-purpose stadium of claim 52 and further including a spectator viewing area for viewing events occurring in either of said first and second activity areas.

59. The multi-purpose stadium of claim 58 wherein said first activity area moves vertically independent of said spectator viewing area.

60. The multi-purpose stadium of claim 58 wherein said spectator viewing area includes mid-level seating which can be stored within said platform.

61. The multi-purpose stadium of claim 58 wherein said spectator viewing area includes an upper seating level, an intermediate seating level, and a lower seating level.

62. The multi-purpose stadium of claim 61 wherein said platform is movable with respect to said second activity area between a lower position, a middle position and an upper position.

63. The multi-purpose stadium of claim 62 wherein in said platform lower position, said first activity area is positioned directly above said second activity area such that an event in said first activity area is viewed by spectators in said intermediate and upper seating levels.

64. The multi-purpose stadium of claim 63 wherein said lower seating level may be moved to a retracted position underneath said upper seating level such that said first activity area may be positioned directly above said second activity area.

65. The multi-purpose stadium of claim 62 wherein in said platform middle position, said first activity area is positioned between said intermediate and upper seating levels such that an event in said first activity area is viewed by spectators in said upper seating level and an event in said second activity level is viewed simultaneously by spectators in said lower and intermediate seating levels.

66. The multi-purpose stadium of claim 62 wherein in said platform upper position, said first activity area encloses an opening in the roof of the stadium such that said natural turf playing field is supported exteriorly from the stadium and an event in said second activity area is viewed by spectators in said lower, intermediate and upper seating levels.

67. The multi-purpose stadium of claim 52 wherein said second activity area may be partitioned by a dividing wall into a first lower arena and a second lower arena.

68. The multi-purpose stadium of claim 67 wherein equipment for said first and second lower arenas may be stored within said platform.

69. The multi-purpose stadium of claim 68 wherein simultaneous events may occur in said first activity area and said first and second lower arenas.

70. A multi-purpose stadium comprising a first activity area and a second activity area positioned below said first activity area, said first activity area being vertically movable with respect to said second activity area allowing for spectator sightlines to be satisfied for events occurring within said first and second activity areas; and a roof having a retractable opening positioned generally above said first activity area, which when opened, is capable of being filled by said first activity area.

71. A multi-purpose stadium comprising a first activity area and a second activity area positioned below said first activity area, said first activity area being vertically movable with respect to said second activity area allowing for spectator sightlines to be satisfied for events occurring within said first and second activity areas; and a roof having a retractable opening positioned generally above said first activity area, said opening being covered by a fixed transparent film with reflective horizontal curtains used to control sunlight.

72. A multi-purpose stadium comprising a first activity area and a second activity area positioned below said first activity area, said first activity area being vertically movable with respect to said second activity area allowing for spectator sightlines to be satisfied for events occurring within said first and second activity areas; and a roof having a retractable opening positioned generally above said first activity area, said opening being covered by a fixed transparent glass with opaque horizontal curtains used to control sunlight.

73. A multi-purpose stadium comprising a first activity area and a second activity area positioned below said first activity area, said first activity area being vertically movable with respect to said second activity area allowing for spectator sightlines to be satisfied for events occurring within said first and second activity areas; and a spectator viewing area for viewing events occurring in either of said first and second activity areas, said spectator viewing area including mid-level seating which can be made part of a vertically movable platform supporting said first activity area above said second activity area.

74. A multi-purpose stadium comprising a first activity area and a second activity area positioned below said first activity area, said first activity area being vertically movable with respect to said second activity area between a lower position, a middle position and an upper position allowing for spectator sightlines to be satisfied for events occurring within said first and second activity areas; and a spectator viewing area for viewing events occurring in either of said first and second activity areas, said spectator viewing area including an upper seating level, an intermediate seating level, and a lower seating level.

75. A multi-purpose stadium comprising a first activity area and a second activity area positioned below said first activity area, said first activity area being vertically movable with respect to said second activity area allowing for spectator sightlines to be satisfied for events occurring within said first and second activity areas, said second activity area being partitioned by a dividing wall into a first lower arena and a second lower arena, and wherein equipment for said first and second lower arenas may be stored within a platform supporting said first activity area.

* * * * *